US007101269B2

(12) United States Patent
Wakazono et al.

(10) Patent No.: US 7,101,269 B2
(45) Date of Patent: Sep. 5, 2006

(54) CYLINDRICAL GRINDING MACHINE

(75) Inventors: Yoshio Wakazono, Nagoya (JP); Toshihiko Shima, Okazaki (JP); Eijii Kato, Nagoya (JP)

(73) Assignee: Toyoda Koki Kabushiki Kaisha, Kariya (JP)

( * ) Notice: Subject to any disclaimer, the term of this patent is extended or adjusted under 35 U.S.C. 154(b) by 179 days.

(21) Appl. No.: 10/760,504

(22) Filed: Jan. 21, 2004

(65) Prior Publication Data

US 2004/0162004 A1 Aug. 19, 2004

(30) Foreign Application Priority Data

Jan. 21, 2003 (JP) ..... 2003-012612
May 15, 2003 (JP) ..... 2003-137119

(51) Int. Cl.
*B24B 5/00* (2006.01)

(52) U.S. Cl. ..... 451/242; 451/246; 451/449; 451/453

(58) Field of Classification Search ..... 451/242, 451/246, 449, 450, 453
See application file for complete search history.

(56) References Cited

U.S. PATENT DOCUMENTS

| | | | | |
|---|---|---|---|---|
| 4,091,572 | A * | 5/1978 | Denning | 451/242 |
| 4,274,229 | A * | 6/1981 | Favrot | 451/221 |
| 4,545,152 | A * | 10/1985 | Grimm | 451/242 |
| 4,607,459 | A * | 8/1986 | Rees | 451/241 |
| 5,414,963 | A * | 5/1995 | Watanabe et al. | 451/72 |
| 5,439,431 | A | 8/1995 | Hessbrüggen et al. | |
| 6,547,498 | B1 | 4/2003 | Sugata et al. | |
| 2002/0033084 | A1 | 3/2002 | Nakaminami et al. | |

FOREIGN PATENT DOCUMENTS

| | | |
|---|---|---|
| EP | 0 568 798 | 11/1993 |
| EP | 1 122 026 | 8/2001 |
| EP | 1 190 792 | 3/2002 |
| JP | 5-16072 | 1/1993 |
| JP | 2002-292546 | 10/2002 |

* cited by examiner

*Primary Examiner*—Eileen P. Morgan
(74) *Attorney, Agent, or Firm*—Oblon, Spivak, McClelland, Maier & Neustadt, P.C.

(57) ABSTRACT

Disclosed is a cylindrical grinding machine of the type that a workpiece support device composed of a work head and a foot stock is mounted on a forward upper portion of a bed while a wheel head unit composed of a slide base and a wheel head is mounted on a rear upper portion of the bed. A coolant collecting vent which takes a rectangular shape as viewed from above vertically extends in the bed and opens to the upper surface of the bed to cover an area that extends from under the workpiece on the workpiece support device to under the forward portion of the wheel head unit. A horizontal vent is provided in the bed to open to the rear surface of the bed and to communicate with the collecting vent. A coolant supply device is inserted at a part thereof into the horizontal vent from the rear surface of the bed to extend an inlet opening into the collecting vent. In one embodiment, the slide base is mounted to straddle over the collecting vent and is guided at both ends thereof on the bed to be movable back and forth, and the wheel head is guided to be movable on the slide base in a right-left direction. In another embodiment, the part of the coolant supply device inserted into the horizontal vent is constituted as a discharge duct, from which a mist discharge duct branches upwardly to be connected to a mist collecting device. Airflow blocking means is provided for permitting the coolant to flow through but for blocking airflow from an outlet port of the discharge duct toward the mist discharge duct.

14 Claims, 12 Drawing Sheets

CYLINDRICAL GRINDING MACHINE

INCORPORATION BY REFERENCE

This application is based on and claims priority under 35 U.S.C. .sctn. 119 with respect to Japanese Applications No. 2003-12612 and No. 2003-137119 filed respectively on Jan. 21 and May 15, 2003, the entire contents of which are incorporated herein by reference.

BACKGROUND OF THE INVENTION

1. Field of the Invention

The present invention relates to a cylindrical grinding machine for grinding a workpiece supported rotatably about an axis, with a grinding wheel which is movable in a lengthwise direction of the workpiece as well as in a direction across thereto. More particularly, it relates to a cylindrical grinding machine particularly designed for efficient discharge of coolant from a machining area to the outside of the grinding machine.

2. Discussion of the Related Art

Cylindrical grinding machines of this kind are of the type that a grinding wheel is movable in a lengthwise direction of a workpiece as well as in a direction across thereto and are known as so called "wheel head traverse type grinding machine". The Japanese unexamined, published patent application No. 2002-292546 discloses one example of the wheel head traverse type grinding machine. In this known grinding machine, a work head and a foot stock collectively referred to as work support device on a bed sustains opposite ends of the workpiece to enable the same to rotate about one axis. Further, on the bed, traverse guide ways parallel to the axis are provided directly on the bed or on a fixed base secured on the bed and a movable base is movably guided along the guide ways. A wheel head rotatably carrying a grinding wheel is mounted on the movable base to be movable back and forth in a direction perpendicular to the traverse guide ways. The wheel head is moved bodily with the movable base in the longitudinal or lengthwise direction and is moved to and from the workpiece on the movable base.

The portion on the bed which is under a machining area including a grinding point where the grind wheel comes into contact with the workpiece is formed as a coolant collecting portion, toward which grinding fluid or coolant ejected to the machining area falls down. The coolant collected by the coolant collecting portion flows along a slanted path on the bed and is returned to a coolant supply device from an outlet opening to the upper surface of the bed. Conventionally, the coolant supply device is arranged separated from the body of the grinding machine to be placed by the lateral portion of the bed. A reservoir section of the coolant supply device is connected through a plastic or vinyl pipe to the outlet to receive the coolant which is discharged from the upper surface of the bed through the outlet to the outside of the machine.

Further, since grinding chips are liable to be deposited on the coolant collecting portion on the bed which is under the machining area, measures are usually taken that coolant is flown all the time on the upper surface of the bed thereby to actively feed the grinding chips toward the outlet. Especially, in a grinding method wherein coolant used therein is restrained in volume to ten percents or less of that used in a traditional grinding method, coolant hardly rushes on the bed and hence, grinding chips are apt to be deposited on the portion of the bed under the machining area. To remove the deposited grinding chips, the measures are taken to make the flow of coolant all the time on the upper surface on the bed.

However, in the aforementioned known cylindrical grinding machine of the wheel head traverse type, most of the coolant supplied to the machining area falls down directly on the coolant collecting portion under the machining area on the upper surface of the bed, which gives rise to a drawback that a thermally adverse influence is exerted on the bed. In particular, where coolant flow is made for discharging grinding chips, thermally adverse influence comes into existence notably as the thermal deformation of the bed and hence, as a dispersion in size of machined workpieces.

In addition, the coolant having fallen down on the coolant collecting portion remains on the bed in a substantial volume until it is flown together with the grinding chip discharge coolant back to the reservoir of the coolant supply device. This makes it unavoidable to use a coolant supply device needing a large volume of coolant, in which case the volume of coolant remaining on the bed for a time lag in collection has to be taken into consideration. As a result, a large burden is imposed not only on the maintenance of the coolant in use but also on the disposal of a large volume dirty coolant having expired its life in use.

Furthermore, most of the coolant having supplied to around the grinding point is collected to the coolant supply device through a predetermined discharge path arranged on the grinding machine, whereas a part of the coolant scatters to make mist staying in the machining area. To this end, in prior art grinding machines, it has been customary that a cover device is provided to surround the machining area and that a mist collection device is arranged to collect mist from the space surrounded by the cover device. On the other hand, most of the coolant falls down onto a portion of the bed under the machining area and is then collected to the coolant supply device through the discharge path formed on the upper surface of the bed. For this reason, there have been needed two systems: a discharge path for collecting the coolant in the form of fluid and a mist collecting path for collecting mist. This disadvantageously results in making the collecting mechanisms for coolant and mist complicated in construction as well as in needing separate maintenance works therefor.

In order to solve the aforementioned problem, in a coolant collecting apparatus for a grinding machine disclosed in Japanese unexamined, published patent application No. 5-16072, a collecting path for the coolant which falls down right under a machining area where a grinding wheel acts on a workpiece is constituted in the form of a duct passing through a bed, and the inside of the duct is exhausted by a mist collecting apparatus. Thus, through the duct, coolant and mist are discharged outside the grinding machine, and the coolant is directly collected by the coolant collecting apparatus, while the mist is sucked by the mist collecting device.

However, in the foregoing coolant collecting apparatus, the mist collecting device not only has a suction inlet which opens to the duct formed in the bed of the grinding machine but also has another suction inlet which opens to a coolant reservoir constituting the coolant collecting device to be spaced apart from the upper surface of the coolant contained in the reservoir. That is, the mist collecting device collects not only the mist passing through the duct but also the mist which is filled up in the reservoir by being atomized when collected into the reservoir. Thus, the capability of the mist collecting device for collecting the mist from the duct, namely from the machining area is reduced by collecting the mist from the reservoir, whereby there occurs a problem that the mist suspended in the machining area cannot be collected effectively or efficiently.

SUMMARY OF THE INVENTION

It is therefore a primary object of the present invention to provide an improved cylindrical grinding machine capable of preventing most of the coolant supplied to a machining area from exerting thermally adverse influence on a bed.

Another object of the present invention is to provide an improved cylindrical grinding machine capable of facilitating coolant to be collected speedily to a reservoir of a coolant supply device without remaining or staying on a bed so that the volume of coolant needed can be reduced substantially.

A further object of the present invention is to provide an improved cylindrical grinding machine capable of efficiently collecting the mist suspended in a machining area.

Briefly, according to the present invention, there is provided a cylindrical grinding machine having a bed; a workpiece support device for rotatably supporting the workpiece about a horizontal axis on the bed; and a wheel head unit rotatably supporting a grinding wheel for grinding the workpiece and guided on the bed to be moveable in a first horizontal direction parallel to the horizontal axis and in a second horizontal direction across the horizontal axis. In the grinding machine, a coolant collecting vent opens to the bed and vertically extends in the bed right under a machining area where the grinding wheel comes into contact with the workpiece. A horizontal vent is formed in the bed in communication with the lower end portion of the coolant collecting vent and horizontally extends to open to a lateral surface of the bed. A coolant collecting device is inserted at at least a portion thereof into the horizontal vent to present a coolant inlet portion thereof under the coolant collecting vent.

With this configuration, almost all the part of the coolant falls down directly into the coolant collecting vent and is returned to the coolant collecting device whose coolant inlet portion is presented under the coolant collecting vent. Thus, the coolant is prevented from remaining or stagnating on the upper surface of the bed, and the almost all the part of the coolant does not touch with the bed. Accordingly, the bed can be relieved of adverse thermal influence by the coolant on one hand, and the required volume of the coolant can be reduced on the other hand.

BRIEF DESCRIPTION OF THE ACCOMPANYING DRAWINGS

The foregoing and other objects and many of the attendant advantages of the present invention may readily be appreciated as the same becomes better understood by reference to the following detailed description of preferred embodiments of the present invention when considered in connection with the accompanying drawings, wherein like reference numerals designate the same or corresponding parts throughout several views, and in which.

DETAILED DESCRIPTION OF PREFERRED EMBODIMENTS

Preferred embodiments of the present invention will be described hereinafter with reference to the accompanying drawings.

(First Embodiment)

Figure 1:
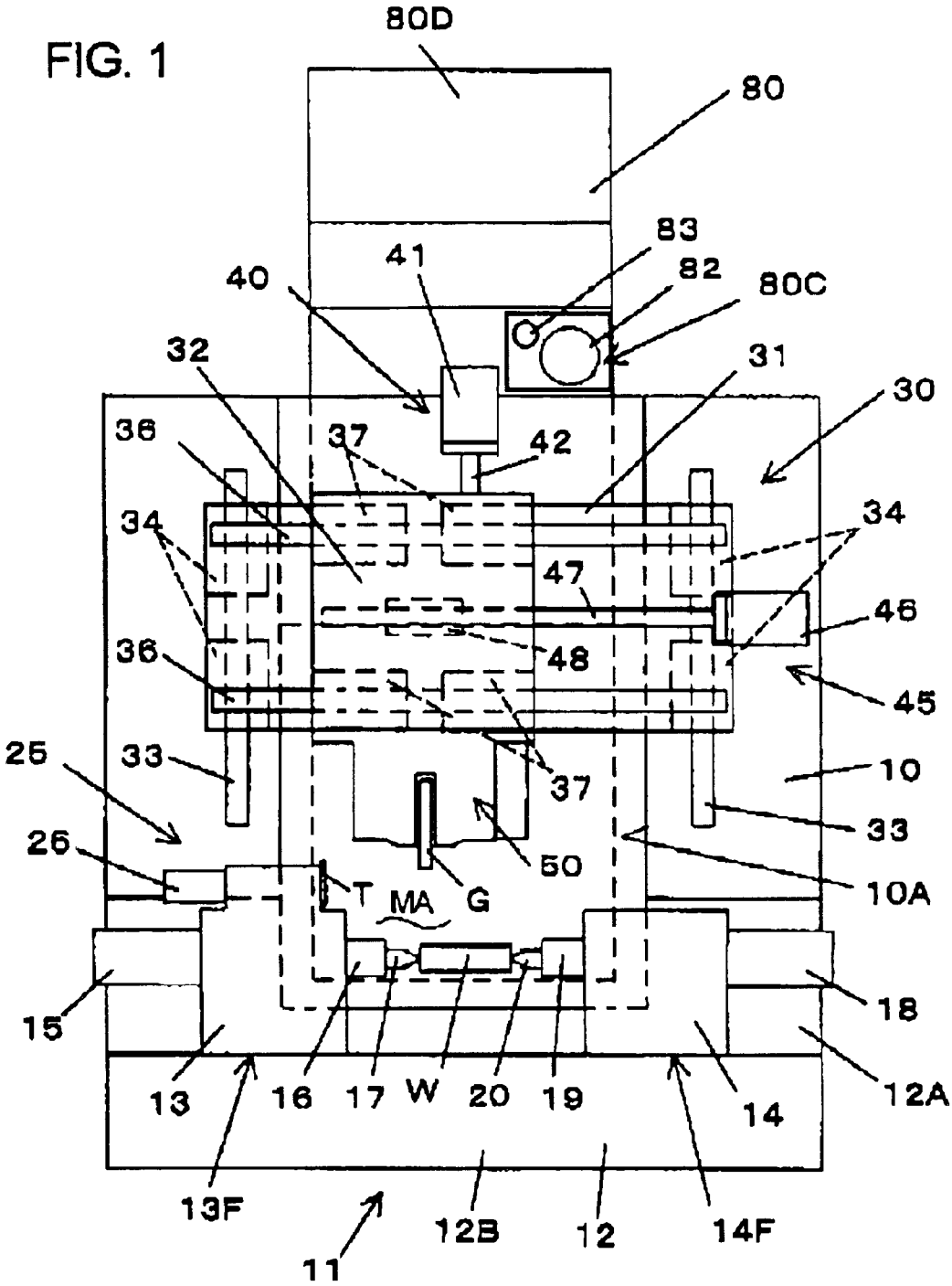
FIG. 1 is a general plan view of a numerically controlled cylindrical grinding machine in the first embodiment according to the present invention.
Figure 2:
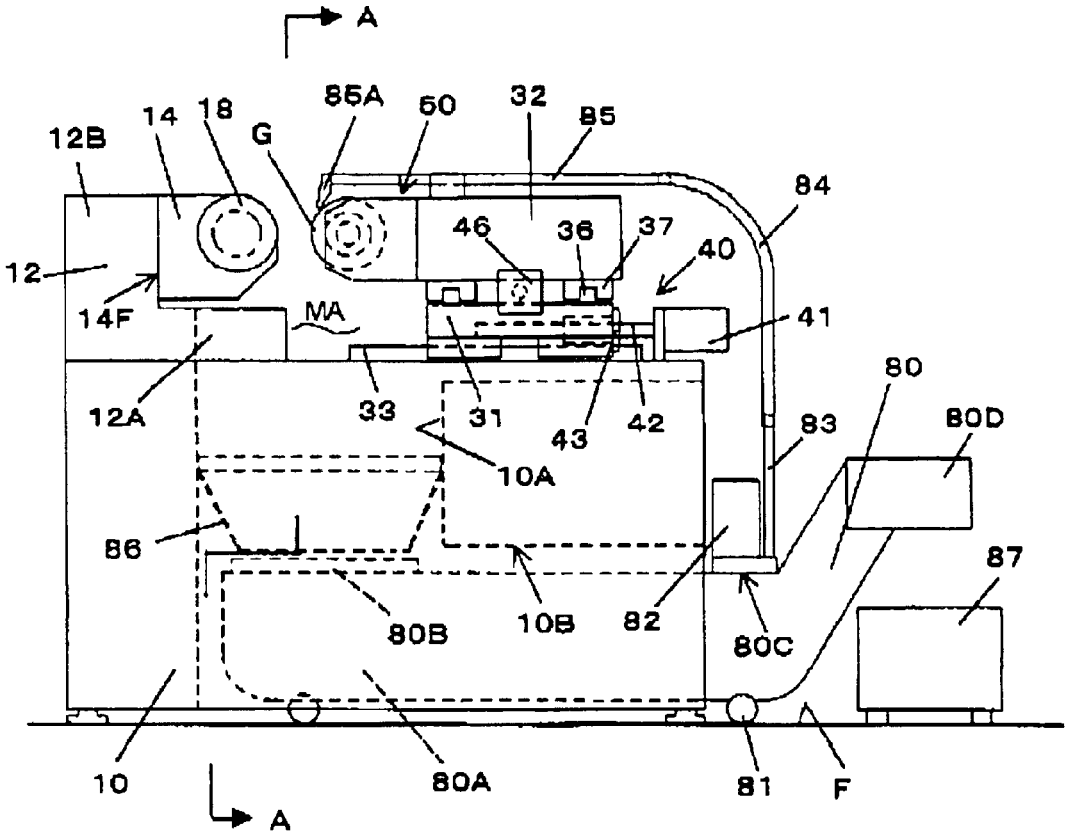
FIG. 2 is a right side view of the grinding machine shown in FIG. 1.
Figure 3:
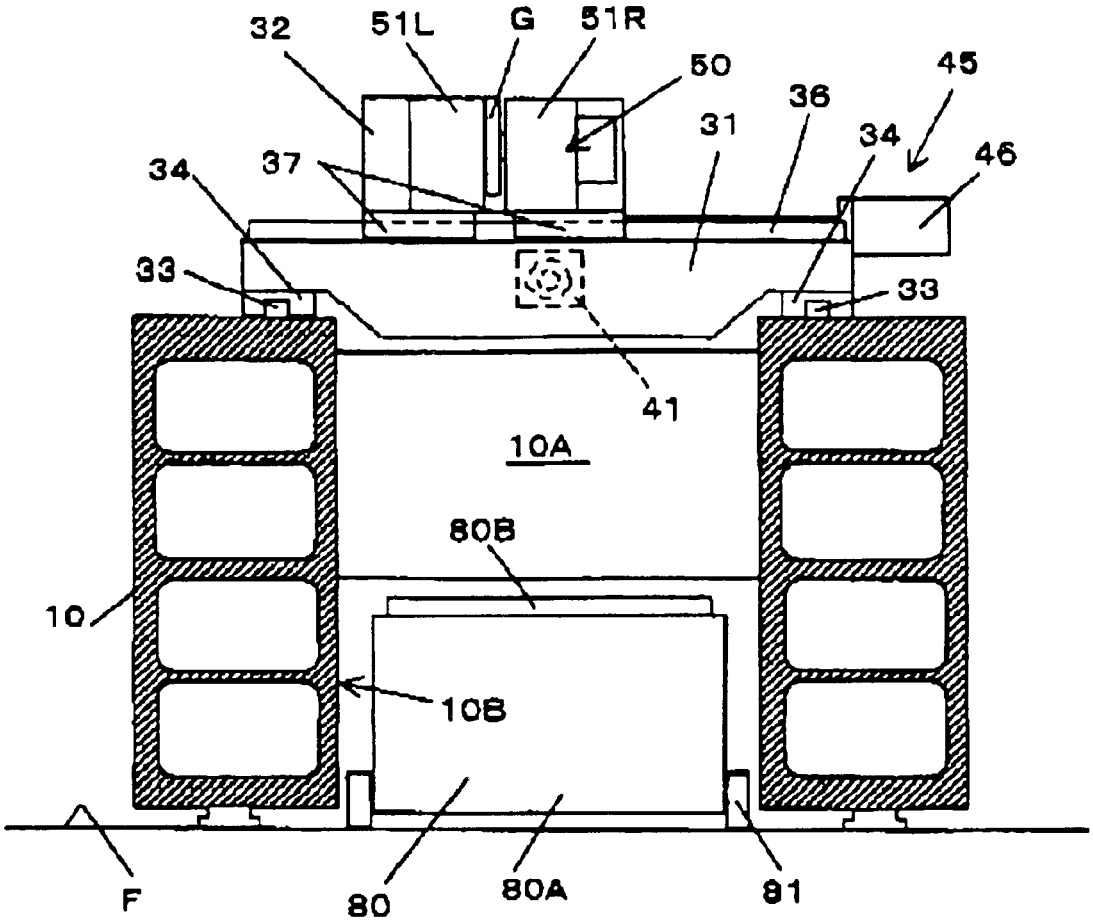
FIG. 3 is a sectional view of the grinding machine taken along the line A—A in FIG. 2.

FIGS. 1 to 3 respectively show a general plan view, a right side view and a sectional view taken along the line A—A in FIG. 2 of a numerically controlled cylindrical grinding machine in the first embodiment according to the present invention. Referring to these figures, a numeral 10 denotes a bed, and a work support device 11 is arranged on the forward portion (below as viewed in FIG. 1) of the bed 10. A support table 12 of an L-shape in cross-section constituting the work support device 11 extends over the entire width of the bed 10, and the support table 12 is fixed at its a base portion 12A on a forward-upper portion of the bed 10. The support table 12 has a vertical wall 12B as upright supporting portion extending upward from the base portion 12A, and a work head 13 and a foot stock 14 are mounted on a vertical surface of the vertical wall 12B to be spaced in the right-left direction (first horizontal direction) from each other. More specifically, the work head 13 and the foot stock 14 are provided at their forward side surfaces with mounting reference surfaces 13F, 14F, at which the work head 13 and the foot stock 14 are fixedly mounted on the vertical wall 12B. The work head 13 is fixedly mounted, while the foot stock 14 is mounted to be movable adjustably in a direction heading for the work head 13 and is secured at the adjusted position on the vertical wall 12B.

The work head 13 rotatably carries a work spindle 16 driven by a servomotor 15 and sustains one end of the workplace W with a center 17 tightly fit in an end portion facing the foot stock 14. On the other hand, the foot stock 14 rotatably carries a foot stock spindle 19 driven by a servomotor 18 about an axis common to the work spindle 16 and sustains the other end of the workpiece W with a center 20 tightly fit in an end portion of the foot stock 14 at the side of the work head 13. In this case, the foot stock spindle 19 is axially movable by a cylinder device (no shown) and is usually urged by a compression spring (not shown) toward the work spindle 13 thereby to axially pressure the workpiece W with a spring force of the compression spring against the work spindle 16 which is immobile axially. The servomotors 15 and 18 are controlled by a CNC (Computer Numerical Control) device (not shown) to be rotated synchronously and constitute a both-end drive mechanism for transmitting rotational powers of the servo motors 15, 18 to the workplace W with friction forces that the centers 17, 20 make in fitting in center holes at the both ends of the workpiece W.

A truing device 25 is provided on another side surface opposite to the mounting reference surface 13F of the work head 13. The device 26 has secured a truing tool T at an extreme end of a truing spindle (not shown) driven by a motor 26 and trues a grinding wheel G with a rotating truing tool T thereby to revive the grinding capability of the grinding wheel G.

A wheel head unit 30 is arranged on a rear-upper surface of the bed 10. The unit 30 is composed of a slide base 31 and a wheel head 32. At both sides of the bed 10 in the right-left direction, a pair of linear guide rails 33 horizontally extend from the mid portion to the rear portion in the forward-rear direction (second horizontal direction). Each guide rail 33 slidably guides a pair of forward and rear bearing blocks 34, which are secured to the lower surface of the slide base 31 at each end portion in the right-left direction. Thus, the slide base 31 is mounted on the bed 10 to be slidable in the forward-rear direction (second horizontal direction).

On the upper surface of the slide base 31, a pair of linear guide rails 36 spaced in the forward-rear direction are secured extending in parallel relation in the right-left direction, and each guide rail 36 slidably guides a pair of right and left bearing blocks 37. The wheel head 32 has secured the pair of bearing blocks 37 on the forward guide rail 36 at its forward lower surface and also has secured the pair of bearing blocks 37 on the rear guide rail 36 at its rear lower surface. Thus, the wheel head 32 is guided to be slidable on the slide base 31 in the right-left direction (first horizontal direction).

A feed device for feeding the slide base 31 in the forward-rear direction comprises an X-axis feed mechanism 40, which is arranged in parallel with the pair of linear guide rails 33 at an intermediate position between these guide rails. This mechanism 40 is composed of a servomotor 41 attached to a rear portion of the bed 10, a feed screw 42 rotated by the same and a nut 43 attached to the lower surface of the slide base 32 in screw engagement with the feed screw 42. The mechanism 40 advances and retracts the slide base 31 and the wheel head 32 thereon in the forward-rear direction upon rotation of the servo motor 41.

On the other hand, a traverse feed device for feeding the wheel head 32 on the slide base 31 in the right-left direction comprises a Z-axis feed mechanism 45, which is arranged in parallel with the pair of linear guide rails 36 at an intermediate position between the same. The mechanism 45 is composed of a servomotor 46 attached to the right end portion of the side base 31, a feed screw 47 rotatable by the same and a nut 48 attached to the lower surface of the wheel head 32 in screw engagement with the feed screw 47. Thus, the mechanism 45 operates to cause the wheel head 32 to traverse in the Z-axis direction upon rotation of the servomotor 46.

Figure 4:
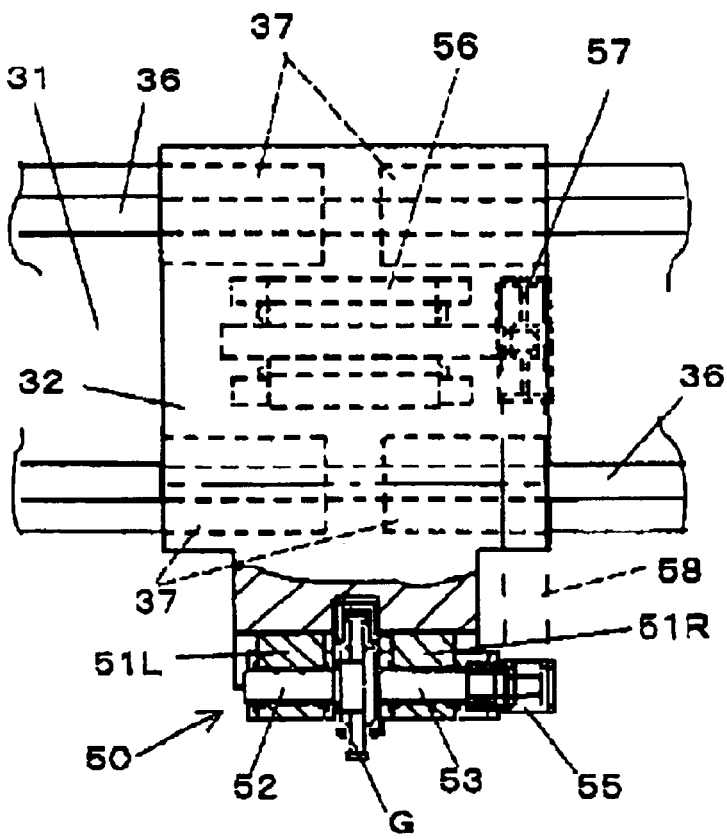
FIG. 4 is a fragmentary plan view partly in section of a wheel head shown in FIG. 1.
Figure 5:
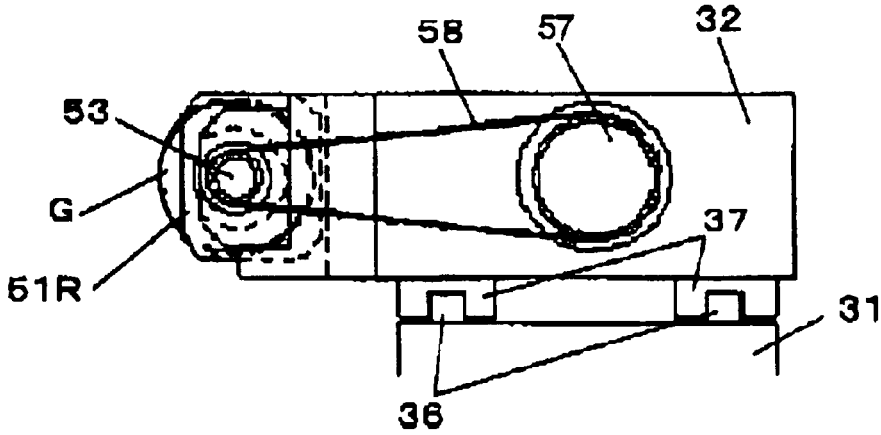
FIG. 5 is a right side view of a wheel head shown in FIG. 4.

The wheel head 32 is provided at its forward portion with a bearing mechanism 50 for rotatably supporting a grinding wheel G. As shown in FIGS. 4 and 5 in detail, the bearing mechanism 50 includes a pair of right and left bearing sections 51R, 51L with a space therebetween for inserting the grinding wheel G. A pair of wheel spindles removably secure the grinding wheel G in engagement with a taper bore formed at the center of a base member of the grinding wheel G. Facing ends of the pair of wheel spindles are constituted to be bodily engageable or separable from each other by a known detaching mechanism, and the base member of the grinding wheel G can be secured at this detachable portion.

More specifically, the wheel spindles are of the combination of a left wheel spindle 52 and a right wheel spindle 53, and the grinding wheel G can be removed from the wheel head 32 by separating the left wheel spindle 52 from the right wheel spindle 53 toward the left. To this end, the left wheel spindle 52 is supported by a radial fluid bearing to be rotatably and axially movably, while the right wheel spindle 53 is supported by a radial fluid bearing and a thrust fluid bearing to be rotatable but not movable axially. The outer or right end of the right wheel spindle 53 has a pulley 55 secured thereto, which is in driving connection with a pulley 57 of a built-in motor 56 by means of a belt 58 to be driven by the built-in motor 56. As the grinding wheel G there is used a CBN grinding wheel which is constituted by forming an abrasive grain layer made of cubic nitride boron particles on the circumferential surface of a disc-like metallic base member.

Referring back to FIGS. 1 to 3, a rectangular coolant collecting vent 10A opens to the top surface of the bed 10 at a position which is the center in the width direction of the bed 10 and which slightly comes forward (below as viewed in FIG. 1) from the center in the forward-rear direction. The coolant collecting vent 10A vertically goes through the bed 10 to open to the lower surface of the bed 10. As shown in FIG. 2, a rectangular horizontal vent 10B opens to the rear surface of the bed 10 and crosses with the collecting vent 10A thereby to communicate therewith. The lower surface of the horizontal vent 10B opens to the lower surface of the bed 10, so that the horizontal vent 10B faces the floor F over the entire length thereof.

A coolant supply device 80 also serving as a coolant collecting device is movable on the floor F through rotations of roller wheels 81, and a part of the device 80, i.e., a horizontal reservoir section 80A is inserted from the rear portion of the bed 10 into the horizontal vent 10B to present a coolant inlet portion 80B right under the coolant collecting vent 10A. The coolant supply device 80 includes a supply section 80C made of a pump unit (not shown) driven by an electric motor 82 and supplies coolant from a supply pipe 83 through a flexible pipe 84 to a coolant nozzle device 85 arranged on the wheel head 32. Thus, the coolant which is ejected from a nozzle 85A of the nozzle device 85 toward a machining area MA encompassing a grinding point therein, falls down directly into the collecting vent 10A and, together with a part thereof guided along a funnel member 86, flows into the coolant inlet portion 80B to be returned to the coolant supply device 80.

A numeral 80D in FIG. 3 denotes a chip discharge portion, through which grinding chips are discharged from the coolant supply device 80 to a chip box 87.

The width (in the horizontal direction) of the collecting vent 10A on the top surface of the bed 10 is taken to be one fourth or so as large as that of the bed 10. Preferably, it maybe designed to be one half as large as the width of the bed 10, or it may be designed so that when the grinding wheel G grinds each end portion of the longest workpiece which can be machined in this grinding machine with the workpiece being set between the work head 13 and the foot stock 14, the collecting vent 10A is present directly under the grinding point. Further, the depth of the collecting vent 10A on the top surface of the bed 10 is such that the forward edge of the collecting vent 10A is advanced ahead of the work spindle 16 axis, while the rear edge thereof is advanced to about the mid position in the forward-rear direction of the slide base 31 when the same is at a grinding position. Preferably, the depth may be chosen to ⅓ to ½ of the bed 10 in the forward-rear direction.

To secure such a depth of the collecting vent 10A, the mid portion of the support base 12 in the width direction is hollowed out. As shown in FIG. 1, the workpiece support system composed of such as the centers 17, 20, the work spindle 16, the foot stock spindle 19 and so forth, inclusive of respective parts of the work head 13 and the foot stock 14, lie within the collecting vent 10A as viewed in the plan view. The forward end portions of the pair of linear guide rails 33 guiding the slide base 31 in the forward-rear direction are advanced forward beyond the rear end edge of the collecting vent 10A. When the slide base 31 advances to stay at a grinding position, the slide base 31 takes such a positional relation that it straddles over the collecting vent 10A, while the overhanging amount of the wheel spindle bearing mechanism 50 from the slide base 31 can be kept a predetermined distance.

(Operation)

Next, the operation of the first embodiment as constructed above will be described. In a traverse grinding, the traverse feed position of the wheel head 32 is controlled, e.g., to bring the grinding wheel G into alignment with one end portion of the workpiece W. Subsequently, the slide base 31 is advanced to make the grinding wheel G grind the one end portion of the workpiece W. Then, the wheel head 32 is moved reciprocatively on the slide base 31, whereby the workpiece surface can be ground over the entire length thereof. Each time the grinding wheel G reaches one or the other end of the workpiece W, the slide base 31 is advanced a predetermined infeed amount. In this manner, all the surface of the workpiece W in the lengthwise direction can be ground with the repetitive executions of the infeed movement and the traverse feed movement.

In a plunge grinding, the position of the wheel head 32 in the lengthwise direction of the workpiece W is controlled thereby to determine a ground position on the workpiece W in the lengthwise direction thereof. Then, the slide table 31 is advanced to perform a plunge grinding.

During the foregoing traverse grinding and the plunge grinding, the nozzle 85A shown in FIG. 2 ejects coolant toward the machining area MA which takes as its center a grinding point or contact point of the grinding wheel G with the workpiece W. The coolant directly falls down into the collecting vent 10A which is large opened right under the machining area MA, to be collected immediately into the coolant supply device 80. In this particular embodiment, the volume of the coolant which remains on the top surface of the bed 10 can be reduced to substantially zero, and the time period for which the coolant remains on the bed 10 from the time when ejected from the nozzle 85A until the time when collected in the coolant supply device 80 is as short as substantially zero. Accordingly, there can be used the coolant supply derive 80 of a small volume type, so that the maintenance cost for the coolant can reduced because of the small volume.

Further, during the grinding operation in which the grinding wheel G is kept in contact with the workpiece W, the slide base 31 lies over the collecting vent 10A. Since the coolant can fall down also through under the slide base 31, the collection of the coolant becomes easy and ensured. In this case, the overhanging amount of the bearing mechanism 50 from the slide base 31 can be minimized owing to the construction that the slide base 31 advances while straddling over the coolant collecting vent 10A in order not to obstruct collecting the coolant. Therefore, the rigidity of the wheel head unit 30 including the slide base 31 and the wheel head 32 can be kept large against the grinding resistance, so that the accuracy of the ground workpieces W can be maintained high. On the contrary, in grinding machines of the prior art type that a wheel head movable back and forth is mounted on a slide base movable right and left, it is unavoidable that the slid base causes an obstruction to collecting the coolant where arrangement is taken to decrease the overhanging amount of the wheel head from the slide base. Conversely, if it is tried to ensure collecting the coolant in the prior art grinding machines, the overhanging amount would necessarily be increased. Thus, this antinomy involved in the grinding machines of the prior art type could not be obviated. In the present embodiment, the problem in this respect can be solved by the foregoing arrangement of the slide base 31 and the wheel head 32.

Furthermore, since the coolant ejected to the machining area MA falls down into the collecting vent 10A opening large, the volume of the coolant remaining on the top surface of the bed 10 can be reduced, so that the adverse influence in thermal dynamics the coolant exerts on the bed 10 can be decreased.

Particularly, in the present embodiment, the bearing mechanism 50 provided at the forward portion of the wheel head 32 is so constructed that the grinding wheel G is supported by the pair of bearing sections 51L, 51R arranged at the both sides thereof. Thus, the bearing rigidity can be heightened compared to the configuration in prior art wherein a grinding wheel is secured on a wheel spindle whose axial one end only is rotatably carried. This means that the wheel spindle 52, 53 can be made as being small in diameter as well as being short in axial length and hence that the bearing mechanism 50 can be miniaturized not only in radial direction but also in right-left direction. This advantageously makes it possible to use the small-diameter grinding wheel G, so that handling the grinding wheel G in wheel exchange operation becomes easy. Additional advantages can be obtained in that the wheel spindle mechanism can be applied to grinding a re-entrant portion on a workpiece circumferential surface for which a large-diameter grinding wheel cannot be used due to the occurrence of interference as is true with a so-called "re-entrant cam".

Further, in truing the grinding wheel G, the same is positioned at one lateral side of a truing tool T, and after the slide base 31 is advanced a predetermined truing infeed amount, the feed movement of the wheel head 32 is controlled to make the grinding wheel G moved reciprocatively across the truing tool T. As shown clearly in FIG. 1, the truing tool T is located over the collecting vent 10A, so that the coolant which is ejected toward the contact point between the grinding wheel G and the truing tool T in truing the grinding wheel G can be made to fall down directly into the collecting vent 10A opening thereunder.

(Second Embodiment)

Next, the second embodiment according to the present invention will be described with reference to FIGS. 6 through 8. In this second embodiment, the slide base 31 is constructed to be moved in the forward-rear direction above the horizontal plane (hereafter as an "axis inclusive plane") which includes the rotational axis of the workpiece W. Of the right and left lateral portions of the bed 10, those from almost the forward-rear mid portion to the rear portion are extended higher than the axis inclusive plane, and the rear surface portion is also extended higher than the axis inclusive plane, so that those extended portions define an upright wall section 10U which continues like an upended U-letter shape as viewed in FIG. 6. The guide rails 33 are fixedly provided on the top surfaces of parallel portions of the upright wall section 10U. The pairs of bearing blocks 34, 34 respectively slidable on the guide rails 33, 33 are secured to the lower end surfaces of both end portions in the right-left direction of the slide base 31, so that the same is movable along the guide rails 33 in the second horizontal direction. The wheel head 32 is mounted on the slide base 31 to be suspended therefrom and is moved along the lengthwise direction of the slide base 31 in the first horizontal direction.

More concretely, the pair of forward and rear linear guide rails 36 are fixedly provided on the lower surface of the slide base 31 to extend in the right-left direction and in parallel relation with each other. The wheel head 32 has secured the pairs of right and left bearing blocks 37, 37 to the forward and rear portions of its upper surface, each pair of the bearing blocks 37 being guided slidably on a corresponding one of the linear guide rails 36, so that the wheel head 32 can be moved right and left along the rails 36. In this case, the Z-axis feed mechanism 45 is composed of the servomotor 46, the feed screw 47 and the nut 48 which are arranged between the guide rails 36 spaced back and forward on the lower surface of the slide base 31. The upright wall section 10U encircles the wheel head 32 thereby to define the moving space for the wheel head 32 and at the same time, also serves to function as a splash cover for preventing coolant from scattering.

By being constructed above, the second embodiment features preventing coolant and grinding chips from scattering over the guide rails 33, 36, so that the guiding performance for the slide base 31 and the wheel head 32 can be maintained precise for a long period of time. Other constructions in the second embodiments are the same as those in the aforementioned first embodiment, wherein the same function members are indicated with the same reference numerals throughout both embodiments.

(Third Embodiment)

Further, the third embodiment according to the present invention will be described with reference to FIGS. 9 and 10. In this third embodiment, the bed 10 is formed to be a U-letter shape as viewed from above, wherein a coolant collecting space 10S is defined to extend from rear to forward of the bed 10. This collecting space 10S opens to upper and lower surfaces of the bed 10 over its whole area in the forward-rear direction beginning from the rear end surface of the bed 10. A horizontal reservoir section 80A of the coolant supply device 80 is fit in the collecting space 10S and is positioned to collect the coolant falling down from the machining area MA through the funnel member 86.

The linear guide rails 33, 33 are fixedly provided respectively on the top surfaces of both upright wall portions 10V, 10V which extend in parallel relation with each other. The slide base 31 is extended to rest on the both upright wall portions 10V, 10V and has the bearing bocks 34, 34 secured to the lower surfaces of its both end portions, so that slide base 31 can be moved back and forward along the guide rails 33, 33. The X-axis feed mechanism 40 in this embodiment comprise two sets for the right and the left, each set being composed of the servomotor 41L (41R), the feed screw 42L (42R) and the nut 43L (43R). The nuts 43L, 43R are secured to nut holder portions which protrude respectively from both end surfaces of the slide base 31.

With this configuration, when the both servomotors 41L, 41R are controlled synchronously, the slide base 31 and the wheel head 32 mounted thereon are moved back and forward. Further, when there is intentionally given a minute difference in rotational amount between the both servomotors 41L and 41R, the wheel head 32 and the grinding wheel G can be tilted a minute angle in a horizontal plane. Therefore, the difference in abrasion at an axial end portion of the grinding wheel G can be rectified or a taper surface can be formed deliberately on the workpiece surface.

Other constructions in the third embodiment are the same as those in the aforementioned first embodiment, wherein the same function members are indicated with the same reference numerals throughout both embodiments.

In this particular embodiment, the coolant collecting space 10S is made large to enlarge the coolant collecting area, so that the collecting of coolant can be ensured. In addition, the freedom is large in choosing coolant collecting means installed within the collecting space 10S. Where there is used a coolant supply device of vertical type whose reservoir is vertically deep, the entirety of the coolant supply device can be housed in the collecting space 10S, so that the floor space necessary for the cylindrical grinding machine can be made smaller.

In this third embodiment, a modification can be made, wherein in substitution for the two sets of X-axis feed mechanisms 40 disposed at right and left sides, a single set of X-axis feed mechanism may be provided on the center portion of a crossbeam which is added to connect the rear end portions of the both upright wall portions 10V, 10V.

(Other Modifications)

Figure 9:
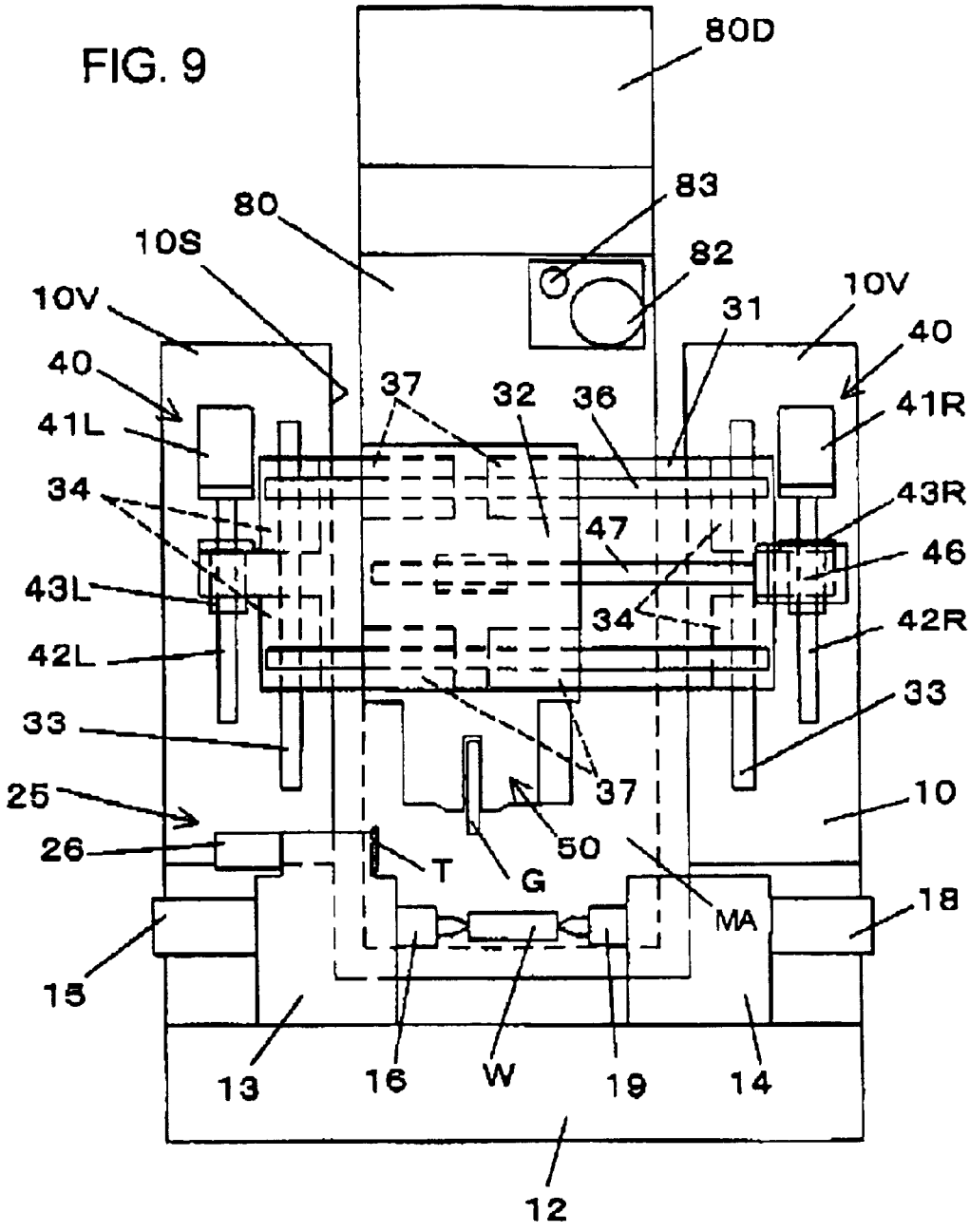
FIG. 9 is a general plan view of a numerically controlled cylindrical grinding machine in the third embodiment according to the present invention.
Figure 10:
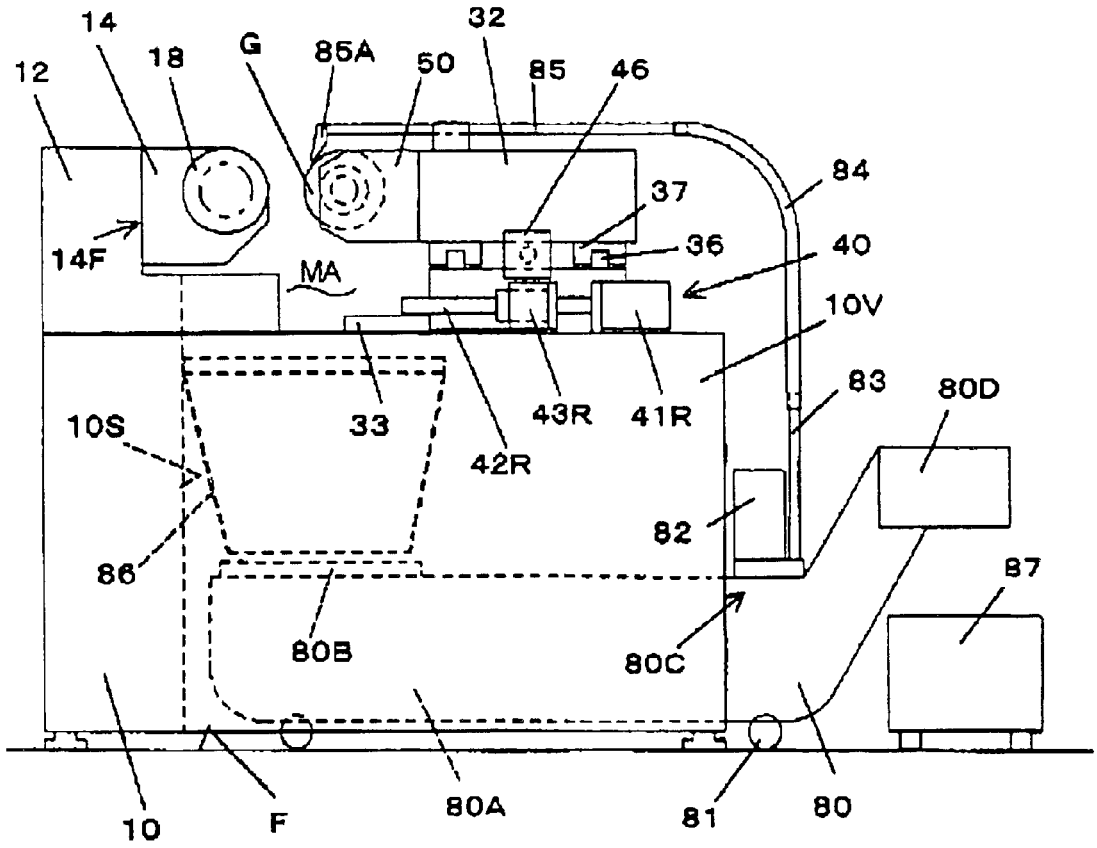
FIG. 10 is a right side view of the grinding machine shown in the third embodiment.

As the X-axis feed mechanism 40 in the first and second embodiments, there can adopted a modified form, wherein like that used in the third embodiment shown in FIG. 9, two sets of X-axis feed mechanisms 40 are arranged at both sides of the slide base 31.

Another modification can be made, in which one or both of the X-axis feed mechanism 40 and the Z-axis feed mechanism 45 in each of the foregoing embodiments is substituted by a linear motor drive mechanism.

Although the work support device 11 is exemplified in the form of both center drive type, there can be used a conventional combination of a dead-center type work head with a work drive face plate and a dead-center foot stock. Where the workpiece to be machined is short axially, the work support device 11 may be composed of a work head with a work clamping chuck without using any foot stock.

Although the wheel head 32 is of the type that it supports both axial sides of the grinding wheel G, it may be of the type that it supports one axial side of the grinding wheel, as well known in the art.

Although the guide mechanisms for the slide bass 31 and the wheel head 32 are each composed of the linear guide rails 33, 36 and the bearing blocks 34, 37, they may be substituted by linear guide mechanisms using slide bearings or fluid bearings.

Although the horizontal vent 10B or the collecting space 10S into which the coolant supply device 80 is inserted or housed opens to the rear surface of the bed 10, it may be provided to open to the right or left lateral surface of the bed 10. As the case may be, it may be provided to open to the forward surface of the bed 10.

Workpieces to be machined cover those of various types which are machined while being rotated like cylindrical workpiece, camshaft, crankshaft or the like.

Various features and many of the attendant advantages in the foregoing first to third embodiments will be summarized as follows:

In the first embodiment typically shown in FIGS. 1 and 2 for example, the bed 10 is provided with the coolant collecting vent 10A opening right under the machining area MA, and the coolant falls down directly into the coolant inlet portion 80B of the coolant supply device 80 which is inserted partly into the horizontal vent 10B of the bed 10 to extend into the coolant collecting vent 10A. Thus, the coolant can be prevented substantially from remaining or stagnating on the top surface of the bed 10, so that the be d 10 can be relieved of being thermally deformed by being caused by the influence of the coolant. Further, the coolant supply device 80 can be of a small capacity storing a small volume coolant.

Also in the first embodiment typically shown in FIGS. 1 and 2 for example, the slide base 31 is provided to be slidable at both ends thereof on the bed 10 in a direction heading for the workpiece W with a mid portion thereof straddling over at least a part of the coolant collecting vent 10A, and the wheel head 32 is mounted on the slide base 31 to be movable in the lengthwise direction of the workpiece W. Thus, when the slide base 31 is advanced to a grinding position, the coolant collecting vent 10A is located right under the slide base 31. This advantageously makes it easy to collect the coolant on one hand and also advantageously makes the rigidity of the machine against the grinding resistance maintained strong without increasing the overhanging distance of the wheel head 32 from the slide base 31 in the direction of advance feed.

Also in the first embodiment typically shown in FIGS. 1 and 2 for example, the first and second support devices 13, 14 for supporting the workpiece W are mounted on the lateral surfaces opposite to those facing the wheel head 32 and have lower end surfaces thereof released. Therefore, the coolant collecting vent 10A can be formed at the portions of the bed 10 facing the lower end surfaces, that is, right under the workpiece W being machined, so that the collecting of the coolant can be ensured.

Further in the first embodiment typically shown in FIGS. 1 and 2 for example, the coolant collecting vent 10*a* vertically passes through the bed 10 to open at the upper and lower surfaces of the bed 10, and the coolant supply device 80 is moved on the floor F and is inserted through the horizontal vent 10B to be presented right under the collecting vent 10A. Thus, the installation of the coolant supply device 80 is easy, and the floor space required for the grinding machine can be made small.

Further in the first embodiment typically shown in FIGS. 1 and 2 for example, the collecting vent 10A is made to be rectangular as viewed from above, the width of the collecting vent 10A is determined so that even when the longest workpiece is set up on the grinding machine, the collecting vent 10A opens right under the both ends of the workpiece, and the depth of the collecting vent 10A is so determined as to exist under the slide base 31 when the same is located at an advanced grinding position. This design of the collecting vent 10A advantageously results in further ensuring the collection of the coolant.

Also in the first embodiment typically shown in FIGS. 3 and 4 for example, the wheel bearing mechanism 50 is miniaturized by being designed to support both sides of the grinding wheel W and is able to advance between the first and second workpiece support heads 13, 14. Thus, it becomes possible to use the small diameter grinding wheel G, so that not only the exchange of the grinding wheel G becomes easy, but it also becomes possible to grind a workpiece having a reentrant portion of a small curvature at the circumferential surface thereof.

Figure 6:
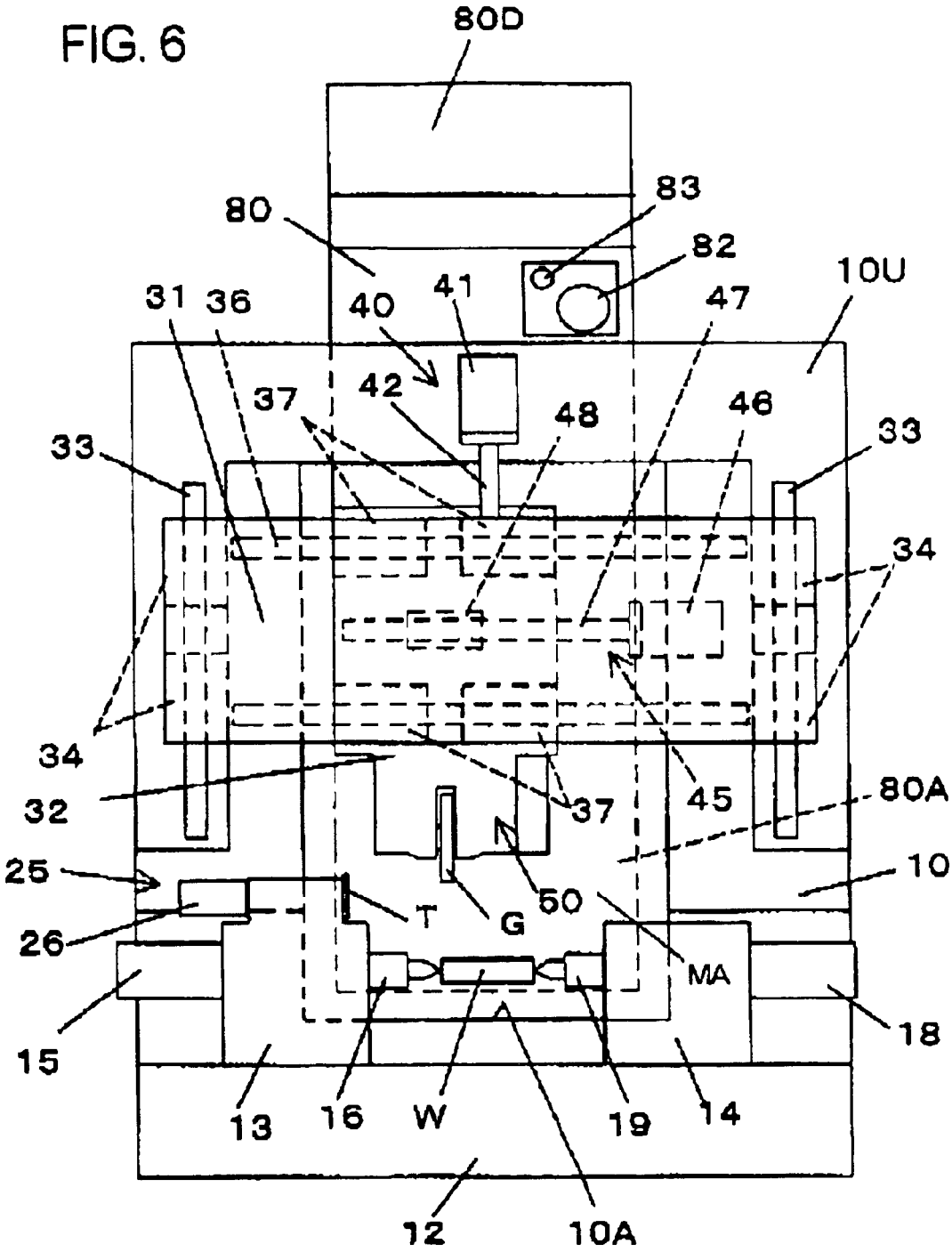
FIG. 6 is a general plan view of a numerically controlled cylindrical grinding machine in the second embodiment according to the present invention.
Figure 7:
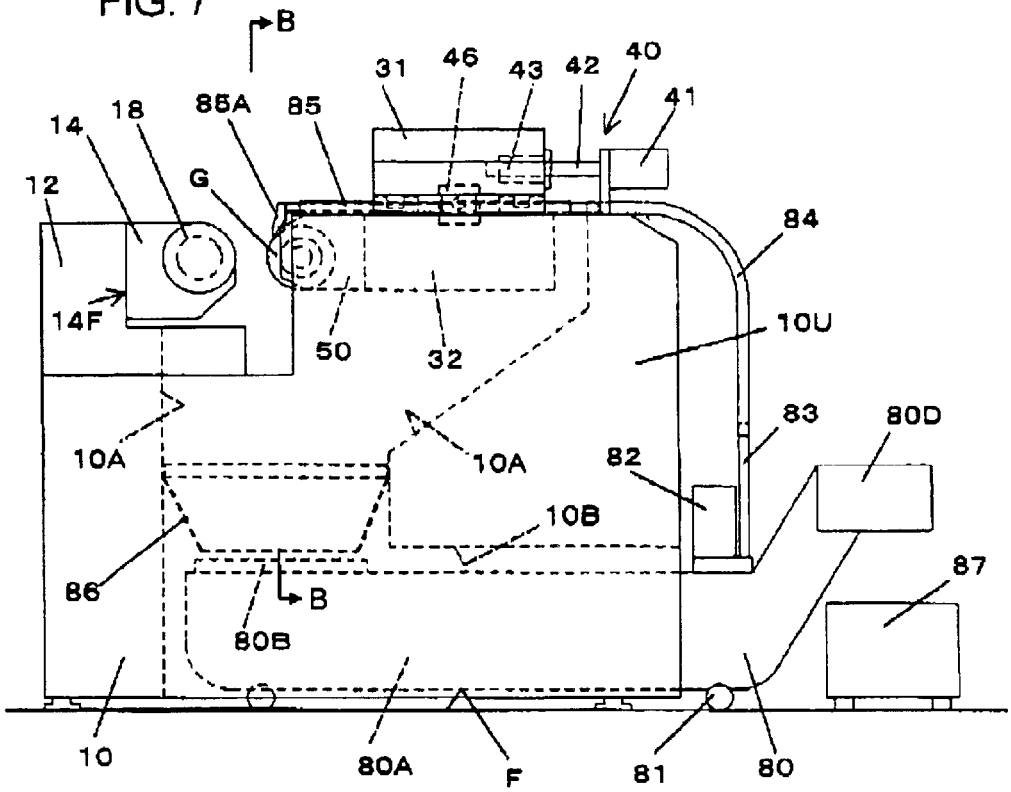
FIG. 7 is a right side view of the grinding machine shown in FIG. 6.
Figure 8:
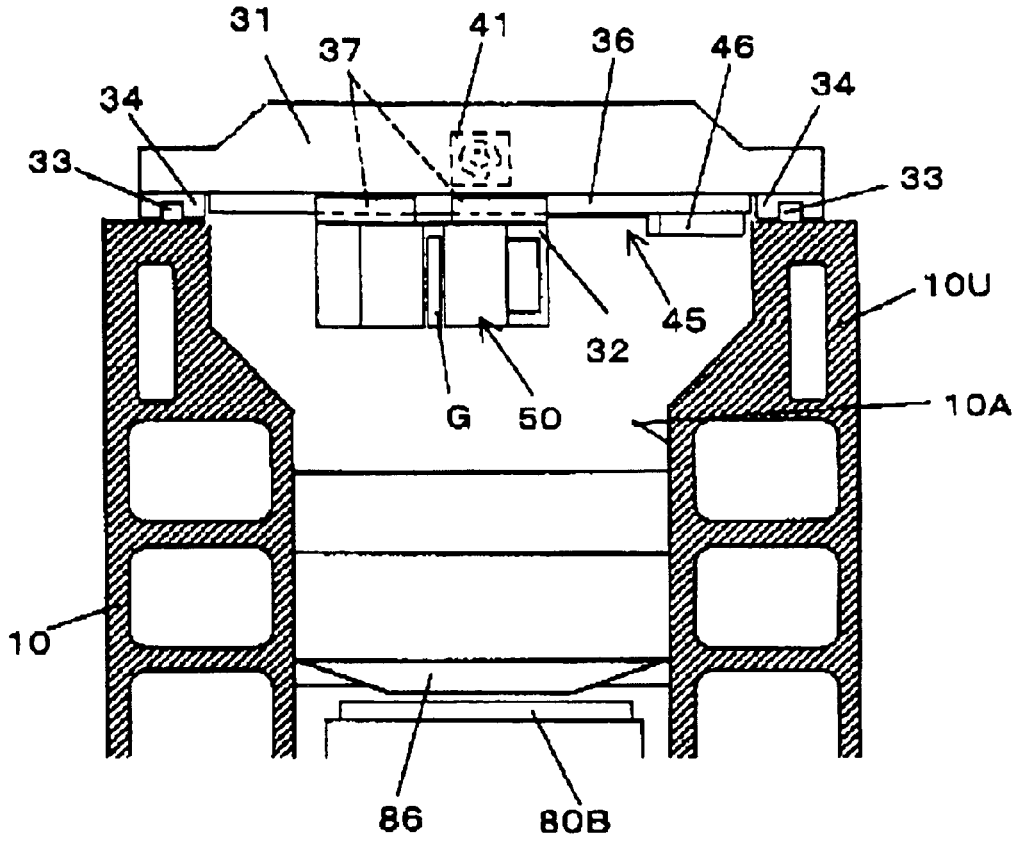
FIG. 8 is a sectional view taken along the line B—B of the grinding machine shown in FIG. 7.

In the second embodiment shown in FIGS. 6 to 8, the guide mechanism for the slide base 31 is arranged above the grinding point, and the wheel head 32 is mounted to be fed in the traverse direction with itself being suspended from the slide base 31. Thus, the guide mechanisms for the slide base 31 and the wheel head 32 are located above the grinding point, so that there can be solved a problem that the coolant scattered from the grinding point goes into the guide mechanisms.

In the third embodiment typically shown in FIG. 9 for example, the bed 10 takes a U-shape as viewed from above, and the central space 10S of the bed 10 is formed as a coolant collecting space, in which the coolant supply device 80 is arranged. Thus, the collecting area for the coolant can be enlarged thereby to make the coolant collection further easer, and the installation of the coolant supply device 80 becomes easier.

(Fourth Embodiment)

Figure 11:
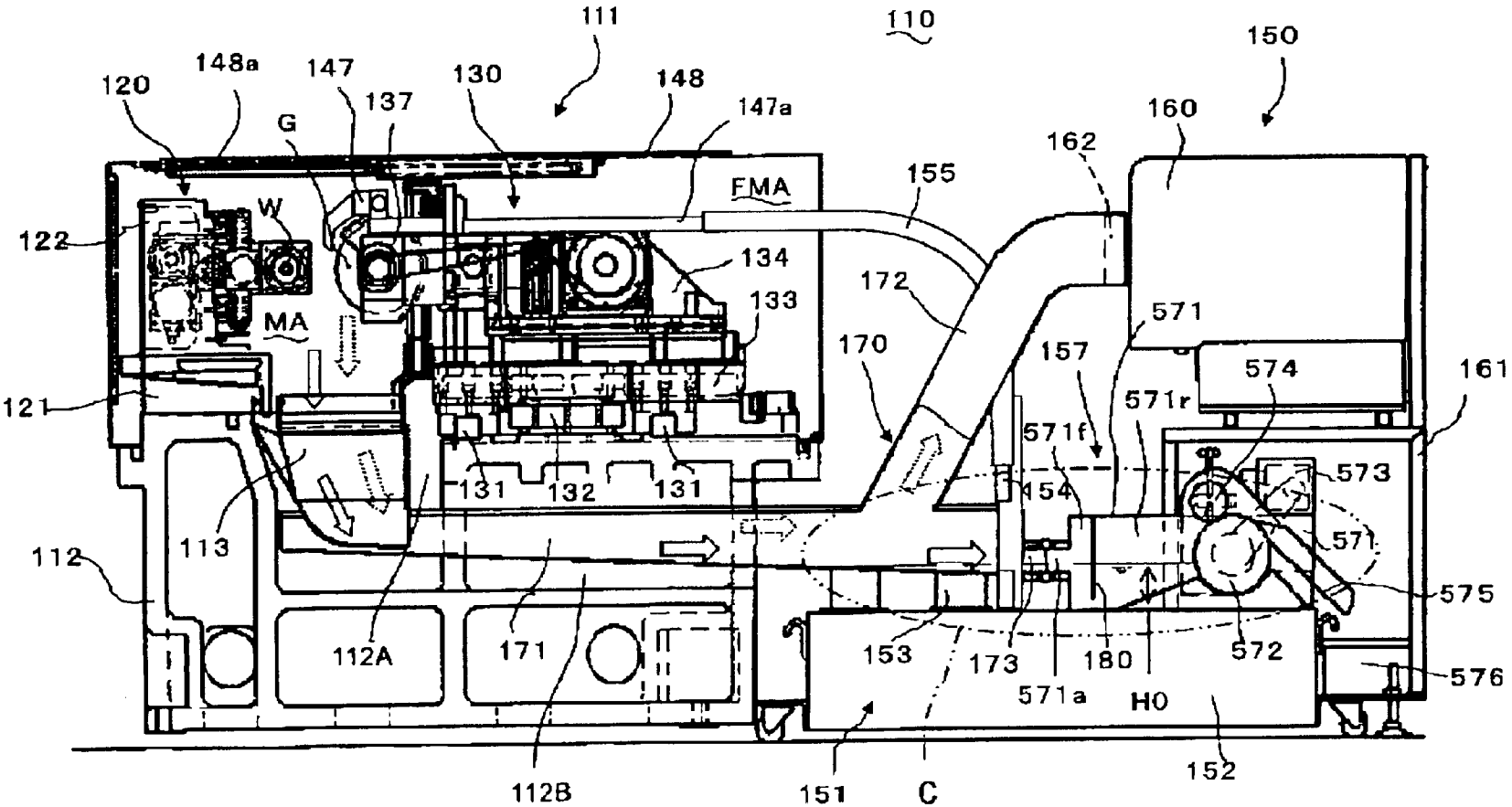
FIG. 11 is a side view partly in section of a cylindrical grinding machine in the fourth embodiment of the present invention.

Next, the fourth embodiment according to the present invention will be described with reference to FIGS. 11 to 13. Referring now to FIG. 11, a numeral 110 denotes a grinding system comprising a cylindrical grinding machine 111 and accessory apparatuses 150. The accessory apparatuses 150 in an illustrated example include a coolant supply device 151, a mist collecting device 160 and a duct device 170 connecting these devices 151, 160 to the grinding machine 111. The coolant supply device 151 and the duct device 171 serve as a coolant collecting device.

The cylindrical grinding machine 111 includes a bed 112. The bed 112 mounts a workpiece support device 120 on a forward (left as viewed) upper surface thereof and a wheel head unit 130 on a rear (right as viewed) upper surface thereof. As enlarged in FIG. 12, the workpiece support device 120 is mounted on a lateral surface of a support 122 which is upstanding on a work table 121 secured on the bed 112, to be adjustable along a pair of linear guide rails 123 extending normal to the drawing sheet and is secured on the lateral surface at an adjusted position. The workpiece support device 120 is composed of a work head 124 and a foot stock (not shown) and supports a workpiece W rotated by a work drive motor 125 about a horizontal axis.

On the other hand, the wheel head unit 130 includes a slide base 133, which is moved by a linear motor 132 in a right-left direction along a pair of linear guide rails 131, 131 (shown in FIG. 1) which are fixed on the rear-upper surface of the bed 112 to extend in a direction normal to the drawing sheet. A wheel head 134 is movable by a linear motor (not shown) back and forth along a pair of linear guides 135 (one only shown in FIG. 12) extending in a forward-rear direction on the slide 133. A wheel bearing unit 137 is mounted on the forward portion of the wheel head 134 and rotatably supports a wheel spindle 138 with a grinding wheel G secured thereto. Through a belt 142, a pulley 139 secured to the wheel spindle 138 is in driving connection with a pulley 141 which is secured to an output shaft of a drive motor 140 mounted on the rear portion of the wheel head 134, so that the rotational power of the drive motor 140 can be transmitted to the wheel spindle 138 and the grinding wheel G. A coolant supply nozzle 147 is provided on the wheel bearing unit 137 and ejects the coolant which supplied from a delivery pipe 147*a* secured to the wheel head 134, toward a grinding point which is a contact point of the grinding wheel G with the workpiece W.

Further, a numeral 145 denotes a belt-tension adjusting mechanism, and a numeral 146 denotes a partition device for partitioning a machining area MA in which the grinding wheel G as machining tool performs machining operations on the workpiece W, from a wheel feed unit installation area FUA. The partition device 146 incorporates therein an X-Y slide cover mechanism which substantially fluid-tightly isolates the machining area MA from the wheel feed unit installation area FUA while permitting the wheel head 134 to move in the right-left direction as well as in the forward-rear direction.

Referring back to FIG. 11, there is shown a box-like cover device 149 comprising right and left lateral plates and a top plate. The box-like cover device 148 constitutes a complete cover device in cooperation with the partition device 146. The box-like cover device 148 and the partition device 146 fluid-tightly isolate the machining area MA in which the workpiece support device 120 and the wheel bearing unit 137 exist, from the outside of the grinding machine as well as from the wheel feed unit installation area FUA and also isolates the wheel feed unit installation area FUA from the outside of the grinding machine. At the portion of the top plate that covers the machining area MA, there is provided a slide-type open/close shutter device 148*a*, which enables a suitable loading/unloading device (not shown) to load workpieces W into the machining area MA and to unload the same therefrom.

Also shown in FIG. 11, at a portion of the bed 112 which forms the lower portion of the machining area MA, a funnel member 113 having a collecting slant surface of a funnel shape is provided for gathering and receiving the coolant ejected from the coolant supply nozzle 147 toward the grinding point. A discharge duct 171 of a duct device 170 is inserted into the bed 112 from a rear opening portion of the bed 112. The funnel member 113 is set in a coolant collecting vent 112A which vertically extends in the bed 112 and opens to the upper surface of the bed 112 right under the machining ar a MA. The discharge duct 171 is set to pass through a horizontal vent 112B which horizontally extends to pass through the rear portion of the bed 112. The horizontal vent 112B communicates with the collecting vent 112A at a forward end thereof and opens to the rear surface of the bed 112 at a rear end thereof thereby to provide the bed 112 with the rear opening portion.

The discharge duct 171 forms a fluid path which is rectangular in cross-section and is closed at its exterior over its entire length to be air-tightly partitioned from the outside. The discharge duct 171 has a cross-section of such a dimension that it is capable of permitting coolant to flow at a lower layer part of the rectangular cross-section area while at the same time, permitting mist of a necessary volume to pass therethrough at a higher layer part of the rectangular cross-section area. The discharge duct 171 is opened at a top surface of the forward end extended right under the machining area MA and air-tightly surrounds the lower end external surface of the funnel member 113 thereby to receive coolant from a lower end opening of the funnel member 113. Although the illustrated funnel member 113 is constituted independently of the bed 112, the collecting slant surface of a funnel shape which the funnel member 113 defines may be formed directly on the bed 112.

From a top opening which is partly formed right before the rear end, the discharge duct 171 upwardly extends and branches a mist discharge duct 172, which is connected to a suction port 162 of the mist collecting device 160 installed on a pedestal 161. The mist collecting device 160 is of a known type that intakes mist from the suction port 162, separates air and liquid from the mist by, e.g., a cyclone separator (not shown) incorporated therein and discharges the air to the atmosphere while returning the liquid or coolant to a coolant reservoir 152 of the coolant supply device 151.

The coolant supply device 151 contains coolant in the reservoir 152, draws the coolant in the reservoir 152 by a pump unit (not shown) driven by a motor 53, and feeds the coolant from an outlet pipe 154 through a flexible pipe 155 to the aforementioned delivery pipe 147*a*.

Further, the coolant supply device 151 has a chip separation device 157 mounted on the reservoir 152. As shown in detail in FIG. 3, the chip separation device 157 is provided with a generally box-shape container 571 for temporarily storing coolant. This container 571 serves as collecting container means into which the coolant from an outlet port 173 at the rear end portion of the discharge duct 171 is flown, and also serves as means for forming a stagnant portion which temporarily stagnate the coolant inside thereof. In order to make the temporal stagnation of coolant, the container 571 is provided with a return tube (not shown) standing upright therein which has an opening at a predetermined level (H0). The lower end of the return tube opens into the reservoir 152, so that the return tube is able to return a part of the coolant into the reservoir 152 when the coolant level in the container 571 exceeds the predetermined level (H0).

Within the container 571, a drum 572 constituting magnetic chip separation means is supported to be rotated by a reduction drive device 573 in a clockwise direction as viewed in FIG. 11. Plural magnetic bars (not shown) which are arranged on the circumferential surface of the drum 672 at equiangular distance magnetically attracts grinding chips mixed in the coolant within the container 571 thereby to separates the grinding chips from the coolant. A rubber roll 574 carried to be rotatable freely is pressured upon the external surface of the drum 572 and serves to separate the liquid component rotated together with the drum 572, from the same. A scraper plate 575 is kept contacted slightly with the external surface of the drum 572, tears iron powder which is drained and compressed with the rubber roll 574, from the drum 572, and guides the torn iron powder along a slanted surface thereby to make the iron power fall into the chip collecting box 576.

The container 571 is provided with a coolant inlet port 571*a* connected to the outlet port 173 at the rear end portion of the duct device 171. Within the container 571 close to the coolant inlet port 571*a*, a partition plate 180 constituting an airflow blocking plate is suspended from the lower surface of the top plate. The partition plate 180 divides the space within the container 571 into an inlet side chamber 571*f* and a chip-separation side chamber 571*r*. However, the partition plate 180 makes the both chambers 571*f*, 571*r* communicate with each other through a bottom area which is close to the bottom surface of the container 571 and which is fairly below the predetermined level (H0), and allows the coolant to flow from the inlet side chamber 571*f* to the chip-separation side chamber 571*r* only through the bottom area.

The upper portion of the drum 572 is exposed to the atmosphere, and the space above the level (H0) within the chip-separation side chamber 571*r* is in communication with the atmosphere, while the space above the level (H0) within the inlet side chamber 571*f* is closed to prevent the air from flowing thereinto. Therefore, when the mist collecting device 160 operates to suck the mist, it can be prevented from sucking the air from the chip-separation side chamber 571*r*, so that the sucking power of the mist collector device 60 can be effectively utilized in sucking the mist within the discharge duct 171 of the duct device 170.

Figure 13:
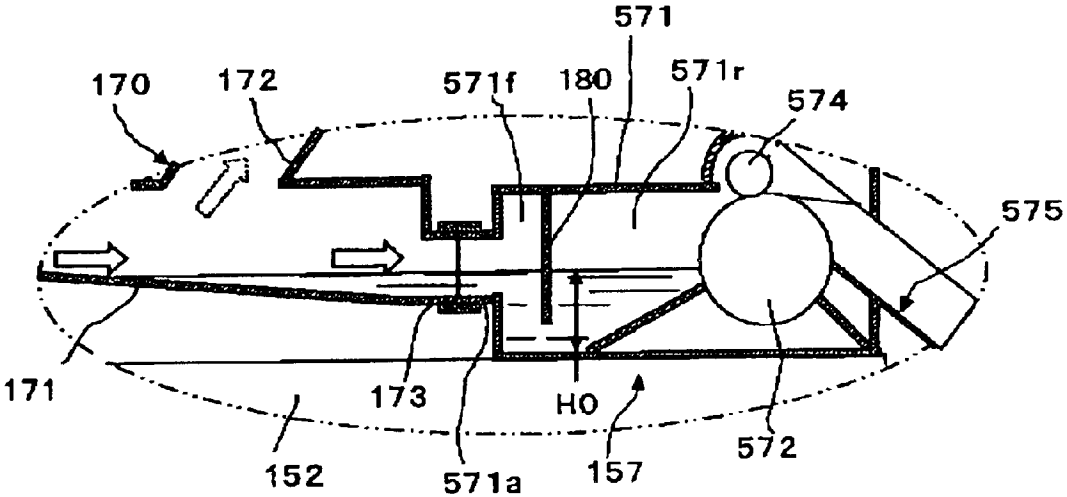
FIG. 13 is an enlarged fragmentary sectional view of a portion C shown in FIG. 11.

As shown clearly in FIG. 13, the discharge duct 171 is designed so that in the state that the coolant temporally remaining in the container 571 is kept at the predetermined level (H0), some coolant remains also in the coolant inlet port 571*a*, the outlet port 173 and the discharge duct 171.

The operation of the fourth embodiment as constructed above will be described hereafter. When a grinding operation is instructed, the workpiece W supported by the work head 124 is rotated, and the positioning feed of the slide base 133 in the right-left direction and the advance feed of the wheel head 134 are performed, whereby the rotating grinding wheel G is brought into engagement with the workpiece W to grind the cylindrical surface of the same. At the same time as the wheel head 134 begins to advance, the motor 153 of the coolant supply device 151 is driven, and coolant is drawn by the pump unit (not shown) to be delivered to the delivery pipe 147*a* through the outlet pipe 154 and the flexible pipe 155. Thus, the coolant is ejected from the coolant supply nozzle 147 toward the grinding point which is the contact point of the grinding wheel G with the workpiece W.

Further, at the same time as the motor 153 of the coolant supply device 151 is driven, the mist collecting device 160 is operated to suck the mist from the mist discharge duct 172. The drum 572 of the chip separation device 157 has been rotated at the same time as the power supply to the grinding machine and continues the operation for chip separation.

Figure 12:
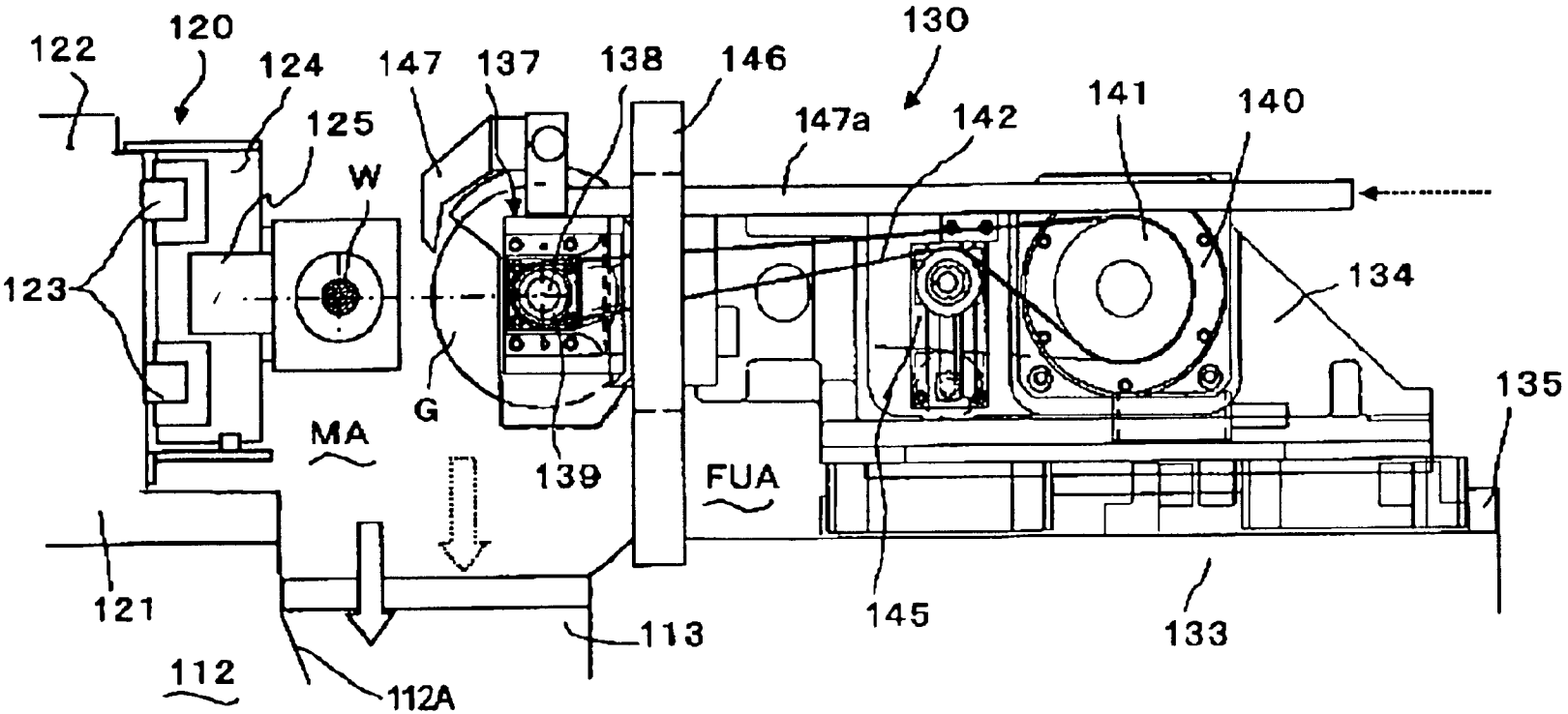
FIG. 12 is an enlarged side view of the construction on a bed of the grinding machine shown in FIG. 11.

The coolant ejected toward the grinding point is collected into the funnel member 113, which is disposed right under the machining area MA, as indicated by the solid line arrow in FIGS. 11 and 12, by the action of the ejecting force of the coolant supply nozzle 147, by being rotated and accelerated with the grinding wheel G which is rotating at a high speed in a counterclockwise direction, or by the gravity. A part of the coolant ejected toward the grinding point scatters to be changed into mist within the machining area MA. At this time, the operation of the mist collecting device 160 has maintained the interiors of the mist discharge duct 172, the discharge duct 171 and the funnel member 113 connected to the forward end of the same at a negative pressure. Thus, the mist within the machining area MA can be sucked in turn into the funnel member 113, the discharge duct 171 and the mist discharge duct 172, whereby the mist generated within the machining area MA can be collected effectively to prevent the machining area MA from being filled with the mist.

In this case, the difference in relative density between the coolant and the mist which flowing through the discharge duct 171 after being collected into the funnel member 113 causes the coolant to flow at the bottom layer portion in the discharge duct 171 and the mist to flow at the space above the flowing coolant in the discharge duct 171. Then, the coolant flows into the inlet side chamber 571*f* which is a front chamber ahead of the partition plate 180 of the chip separator device 157 and passes below the lower end of the partition plate 180 to flow into the chip-separation side chamber 571*r* which is a rear chamber behind of the partition plate 180. Thus, the coolant is treated by the drum 572 to have grinding chips separated therefrom, and the coolant from which grinding chips have been separated is flown into the upper opening of the return pipe (not shown) to be returned into the reservoir 152.

On the other hand, the mist passing through the upper space within the discharge duct 171 is sucked into mist discharge duct 172. The partition plate 180 blocks the airflow from the chip-separation side chamber 571*r* into the inlet side chamber 571*f*, and thus, the space from a branch point where the mist discharge duct 172 branches from the discharge duct 171 of the duct device 170, to the inlet side chamber 571*f* is defined as a closed space into which gas is prevented from flowing. Therefore, the negative pressure generated within the mist discharge duct 172 solely serves to make the space within the discharge duct 171 negative in pressure, so that the sucking power of the mist collecting device 160 reaches the funnel member 113 and further reaches the machining area MA. As a consequence, the mist generated within the machining area MA can be effectively sucked into the mist collecting device 160.

Further, the mist sucked into the mist collecting device 160 is separated into air and coolant under the action of, e.g., centrifugal force, and the air is ejected into the atmosphere while the coolant is returned into the reservoir 152. In addition, the machining area MA is closed at the forward and rear sides, the right and left sides and the top side except for the lower side by the cooperation of the cover device 148 with the partition device 146 to be isolated from the outside of the grinding machine and from the wheel feed unit installation area FUN. Thus, applying the suction power to the machining area MA can be further strengthened, so that the mist sucking function of the mist collecting device 160 can be further facilitated.

(Fifth Embodiment)

Figure 14:
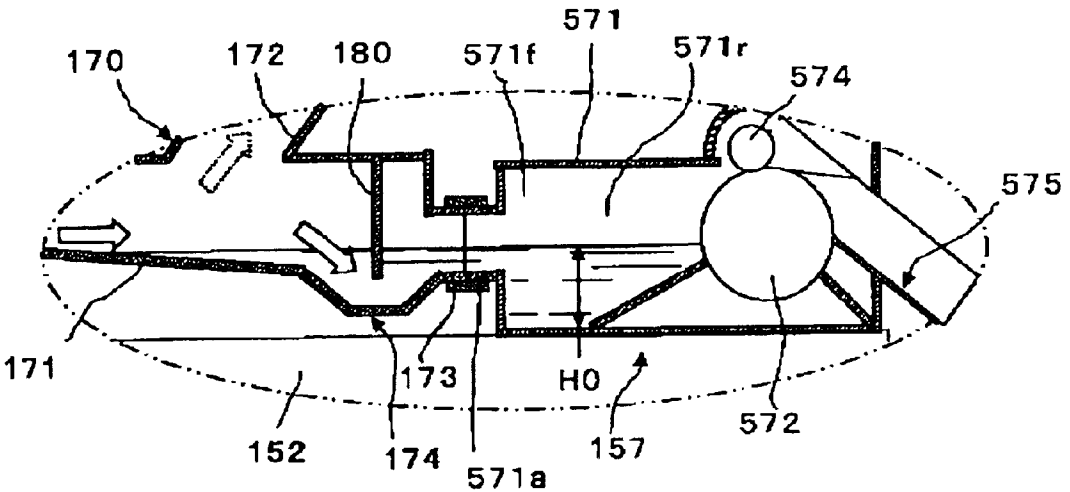
FIG. 14 is an enlarged fragmentary sectional view of the portion C shown in FIG. 11 in the fifth embodiment.

Next, the fifth embodiment according to the present invention will be described with reference to FIG. 14. In this fifth embodiment, as shown in FIG. 14, the partition plate 180 is removed from the container 571 of the chip separation device 157 and is arranged between the branch point where the mist discharge duct 172 branches from the discharge duct 171 and the outlet port 173. The partition plate 180 is set to place the lower end edge thereof at the same level as the surface of the coolant or below. Thus, when the coolant flows within the discharge duct 171, the surface of the coolant blocks the space below the lower end edge of the partition plate 180. This advantageously results in preventing the air from flowing from the side of the outlet port 173 to the side of the mist discharge duct 172. Thus, the suction power of the mist collecting device 160 generated within the mist discharge duct 172 is applied solely into the discharge duct 171, so that the suction capability of the mist collecting device 160 can be utilized for mist collection. In order to ensure that the partition plate 180 blocks the airflow when no coolant flows within the discharge duct 171, it is desirable to set the lower end edge of the partition plate 180 somewhat lower than the surface of the coolant which remains at the predetermined level (H0) within the chip separation device 157.

Where a space sufficient for coolant to pass through is difficult to secure between the lower end edge of the partition plate 180 and the bottom surface of the discharge duct 171, a stagnant portion 174 for coolant is provided at a bottom portion of the discharge duct 171 facing the lower end edge of the partition plate 180, and the partition plate 180 is set to extend the lower end edge thereof lower than the surface of the coolant which remains or stays in the stagnant portion 174. In the case that the partition plate 180 is set to be extended into the stagnant portion 174 formed on the discharge duct 171 of the duct device 170, it may be unnecessary to make the coolant remain at the outlet port 173. In this modified case, the outlet port 173 may be opened to the atmosphere with itself being so oriented as to discharge the coolant toward the coolant storage means or collecting means provided below without being connected with the storage or collecting means continuously.

That is, where a centralized coolant system is used in which a coolant collecting pit is dug in a factory floor for collecting the coolants discharged from plural machine tools, the outlet port 173 of the discharge duct 71 is unnecessary to be connected through a conduit to the pit as far as it is oriented to discharge the coolant toward the pit. It is to be noted that the provision of the stagnant portion 174 in the fifth embodiment is for the purpose of implementing the fifth embodiment in a preferred form and is therefore not essential to the implementation of this fifth embodiment.

In the aforementioned fourth and fifth embodiments, the partition plate 180 is used as means for allowing liquid to pass below thereof but for blocking the flow of gas, and such means may be substituted by various other means.

Further, in the fourth and fifth embodiments, the coolant discharged from the outlet port 173 of the discharge duct 171 is flown into the chip separation device 157. However, in the case that as shown in FIG. 14, the partition plate 180 is placed right before the outlet port 173 to prevent air from being sucked into the mist discharge duct 172 and it is not the case that the chip separating device 157 is to be used, an arrangement may be made to return the coolant from the outlet port 173 directly to the reservoir 152.

Further, although the mist collecting mechanism as described above is applied to the grinding machine which employs water soluble coolant as the coolant, it may also applied to the grinding machine which employs oil-base coolant.

Various features and many of the attendant advantages in the foregoing fourth and fifth embodiments will be summarized as follows:

In the fourth embodiment typically shown in FIGS. 11 and 13 for example, when the mist collecting device 160 is operated to make the inside of the mist discharge duct 172 negative in pressure, the airflow blocking means (i.e., the partition plate) 180 permits the flow of the coolant from the outlet port 173 toward the collecting container means 157 but blocks the airflow from the outlet port 173 toward the mist discharge duct 172. Thus, there can be obviated a drawback that the mist which flows together with coolant in the discharge duct 171 cannot be effectively sucked into the mist discharge duct 172 because air is sucked from the outlet port 173 provided at the end of the discharge duct 171 into the mist discharge duct 172. Thus, the mist flowing through the discharge duct 171 can be sucked into the mist discharge duct 172 with a large suction power. As a result, there can be attained a practical advantage that the performance for collecting the mist can be remarkably enhanced.

Also in the fourth and fifth embodiments typically shown in FIGS. 13 and 14 for example, stagnating m ans (i.e., the container 571 or the stagnant portion 174) is able to make the coolant flow through or remain therein, and the coolant which passes through or remains in the stagnating means cooperates with the partition plate 180 to block the airflow through the stagnating means. Thus, the function to flow the coolant and to block the airflow can be realized by the construction which is free of malfunction, simple in construction and low in cost.

Also in the fourth embodiment typically shown in FIG. 13 for example, the container 571 capable of maintaining the coolant therein at the predetermined level (H0) is connected to the outlet port 173 provided at the end of the discharge duct 171, and the partition plate 180 is suspended from the top plate of the container 571. Thus, the function to flow the coolant and to block the airflow can be realized by the construction which is free of malfunction, simpler in construction and lower in cost.

Also in the fourth embodiment typically shown in FIG. 13 for example, there is utilized the coolant supply device 151 which is composed of the coolant reservoir 152 and the chip separation device 157 for conventional use in machine tools. By providing the chip separation device 157 with the partition plate 180, the function to flow the coolant and to block the airflow can be successfully added to the chip separation device 157. Thus, there can be attained an effective mist collecting function by the addition of a piece of the partition plate 180 to the conventional coolant supply device 151.

Also in the fourth embodiment typically shown in FIGS. 11 and 12 for example, the cover device 148 and the partition device 146 are provided to define the four lateral sides and the top side of the machining area MA. Thus, the machining area MA can be defined substantially as a closed space which blocks the air to flow therein from the outside. This advantageously ensures that the suction power generated by the mist collecting device 160 is applied to the machining area MA, so that the mist scattering within the machining area MA can be effectively collected without being filled up therein.

Obviously, numerous modifications and variations of the present invention are possible in light of the above teachings. It is therefore to be understood that within the scope of the appended claims, the present invention may be practiced otherwise than as specifically described herein.

What is claimed is:

1. A cylindrical grinding machine having a bed; a workpiece support device for rotatably supporting said workpiece about a horizontal axis on said bed; and a wheel head unit rotatably supporting a grinding wheel for grinding said workpiece and guided on said bed to be movable in a first horizontal direction parallel to said horizontal axis and in a second horizontal direction extending across said horizontal axis; said grinding machine comprising:

a coolant collecting vent opening to said bed and vertically extending directly under a machining area where said grinding wheel comes into contact with said workpiece;

a horizontal vent formed in said bed in communication with a lower end portion of said coolant collecting vent and horizontally extending to open to a lateral surface of said bed; and a coolant collecting device having a portion for collecting said coolant and having at least a portion thereof including a coolant inlet portion inserted into said horizontal vent to present said coolant inlet portion under the coolant collecting vent, wherein said wheel head unit comprises:

a slide base guided at both ends of said slide base on said bed to be movable back and forward in said second horizontal direction with a mid portion of said slide base straddling over at least a part of said coolant collecting vent; and a wheel head guided on said slide base to be movable in said first horizontal direction and rotatably supporting said grinding wheel.

2. The cylindrical grinding machine as set forth in claim 1, wherein said workpiece support device comprises:

a support table provided at said bed on an upper portion of said bed and formed with an upright support portion extending in said first horizontal direction; and first and second support heads mounted on said support portion of said support table and arranged spaced in said first horizontal direction for rotatably supporting ends of said workpiece, at least one of said first and second support heads being provided with drive means for rotating said workpiece; and wherein lower portions of said first and second support heads are not secured to said support table.

3. The cylindrical grinding machine as set forth in claim 1, wherein:

said coolant collecting vent has a rectangular shape as viewed from above;

the width of said coolant collecting vent in said first horizontal direction is set so that said coolant collecting vent opens directly under both ends of any workpiece supported by said workpiece support device; and the depth of said coolant collecting vent in said second horizontal direction is set so that said coolant collecting vent faces the lower surface of said slide base when said grinding wheel is advanced to a grinding position to grind said workpiece.

4. The cylindrical grinding machine as set forth in claim 1, wherein said wheel head is provided with a pair of bearing sections at opposite sides of said grinding wheel for rotatably supporting said grinding wheel at the opposite sides thereof.

5. The cylindrical grinding machine as set forth in claim 1, wherein:

said slide base is guided at both end portions thereof to be movable back and forth in said second horizontal direction above a grinding point at which said grinding wheel comes into contact with said workpiece;

said wheel head is suspended from said slide base to be movable back and forth in said first horizontal direction; and first guide means on said bed for guiding said slide base and second guide means on said slide base for guiding said wheel head are disposed at higher positions than said grinding point.

6. A cylindrical grinding machine having a bed; a workpiece support device for rotatably supporting said workpiece about a horizontal axis on said bed; and a wheel head unit rotatably supporting a grinding wheel for grinding said workpiece and guided on said bed to be movable in a first horizontal direction parallel to said horizontal axis and in a second horizontal direction extending across said horizontal axis; said grinding machine comprising:

a coolant collecting vent opening to said bed and vertically extending directly under a machining area where said grinding wheel comes into contact with said workpiece;

a horizontal vent formed in said bed in communication with a lower end portion of said coolant collecting vent and horizontally extending to open to a lateral surface of said bed; and a coolant collecting device having a portion for collecting said coolant and having at least a portion thereof including a coolant inlet portion inserted into said horizontal vent to present said coolant inlet portion under the coolant collecting vent, wherein:

said coolant collecting vent passes through said bed from an upper surface of said bed to a lower surface of said bed to open to a floor surface on which said grinding machine is installed; and said coolant collecting device is movable on said floor surface.

7. A cylindrical grinding machine having a bed; a workpiece support device for rotatably supporting said workpiece about a horizontal axis on said bed, and a wheel head unit rotatably supporting a grinding wheel for grinding said workpiece at a machining area and guided on said bed to be movable in a first horizontal direction parallel to said horizontal axis and in a second horizontal direction extending across said horizontal axis; wherein said bed, as viewed from above, takes the form of a U-letter shape which opens at the rear end portion of said bed and defines a vent space at the central portion of said bed for use as a coolant collecting space, said vent space being present directly under said machining area; said grinding machine comprising:

a coolant supply device inserted into said bed from the opened rear end portion of said bed and presenting a coolant inlet portion thereof directly under said vent space for collecting the coolant falling down from a machining area in which said grinding wheel grinds said workpiece; and a slide base included in said wheel head unit and guided at both ends thereof on said bed to be movable in said second horizontal direction with a mid portion of said slide base straddling over said vent space.

8. A cylindrical grinding machine having a bed; a workpiece support device for rotatably supporting said workpiece about a horizontal axis on said bed; and a wheel head unit rotatably supporting a grinding wheel for grinding said workpiece and guided on said bed to be movable in a first horizontal direction parallel to said horizontal axis and in a second horizontal direction extending across said horizontal axis; said grinding machine comprising:

a coolant collecting vent opening to said bed and vertically extending directly under a machining area where said grinding wheel comes into contact with said workpiece;

a horizontal vent formed in said bed in communication with a lower end portion of said coolant collecting vent and horizontally extending to open to a lateral surface of said bed; and a coolant collecting device having a portion for collecting said coolant and having at least a portion thereof including a coolant inlet portion inserted into said horizontal vent to present said coolant inlet portion under the coolant collecting vent, wherein said coolant collecting device comprises:

a funnel member provided in said coolant collecting vent directly under said machining area for gathering coolant falling down into said coolant collecting vent;

a discharge duct inserted into said horizontal vent from the opening formed at said lateral surface of said bed and presenting one end of said discharge duct opening under said funnel member for feeding coolant gathered by said funnel member outside said bed;

a mist discharge duct branching from said discharge duct adjacent another of said discharge duct and extending upward;

a mist collecting device connected to said mist discharge duct for sucking the mist from said mist discharge duct; and airflow blocking means for permitting the coolant to go out from an outlet port provided at the other end of said discharge duct, but blocking the airflow from said outlet port toward said mist discharge duct.

9. The cylindrical grinding machine as set forth in claim 8, wherein said airflow blocking means comprises:

means for forming a stagnant portion which is capable of enabling coolant to flow or to remain; and a partition plate having a lower end edge extended into the coolant which is flowing or remaining in said stagnant portion, for blocking the airflow above the surface of the coolant remaining in said stagnant portion, but permitting the coolant to flow through a space below said lower end edge thereof.

10. The cylindrical grinding machine as set forth in claim 9, wherein said means for forming said stagnant portion comprises:

a container connected to said outlet port at said other end of said discharge duct and capable of maintaining the coolant flowing thereinto from said outlet port at a predetermined level; and wherein said partition plate is suspended from a top plate of said container with said lower end edge extending into the coolant remaining within said container for partitioning a space at the side of said outlet port of said container to be blocked from the atmosphere.

11. The cylindrical grinding machine as set forth in claim 10, wherein said coolant collecting device further comprises:

a chip separation device for magnetically separating grinding chips from the coolant flowing into said container; and a coolant reservoir for receiving overflow coolant discharged from said container so that said container maintains the coolant flowing therein at said predetermined level.

12. The cylindrical grinding machine as set forth in claim 8, wherein said airflow blocking means comprises:

a partition plate suspended from a top plate of said discharge duct between a branch point where said mist discharge duct branches from said discharge duct and said outlet port and extending at a lower end portion thereof below the surface of the coolant flowing in said discharge duct for blocking the airflow through a space above the surface of the coolant.

13. The cylindrical grinding machine as set forth in claim 8, further comprising:

cover means for covering four lateral surfaces and a top surface of said machining area.

14. A cylindrical grinding machine having a bed; a workpiece suppport device for rotatably supporting said workpiece about a horizontal axis on said bed; and a wheel head unit rotatably supporting a grinding wheel for grinding said workpiece and guided on said bed to be movable in a first horizontal direction parallel to said horizontal axis and in a second horizontal direction extending across said horizontal axis; said grinding machine comprising:

a coolant collecting vent opening to said bed and vertically extending directly under a machining area where said grinding wheel comes into contact with said workpiece;

a horizontal vent formed in said bed in communication with a lower end portion of said coolant collecting vent and horizontally extending to open to a lateral surface of said bed; and a coolant collecting device having a portion for collecting said coolant and having at least a portion thereof including a coolant inlet portion inserted into said horizontal vent to present said coolant inlet portion under the coolant collecting vent, wherein said workpiece support device comprises:

a support table provided at said bed on an upper portion of said bed and formed with an upright support portion extending in said first horizontal direction; and first and second support heads mounted on said support portion of said support table and arranged spaced in said first horizontal direction for rotatably supporting ends of said workpiece, at least one of said first and second support heads being provided with drive means for rotating said workpiece; and wherein lower portions of said first and second support heads are not secured to said support table.

* * * * *

UNITED STATES PATENT AND TRADEMARK OFFICE

CERTIFICATE OF CORRECTION

PATENT NO. : 7,101,269 B2
APPLICATION NO. : 10/760504
DATED : September 5, 2006
INVENTOR(S) : Wakazono et al.

It is certified that error appears in the above-identified patent and that said Letters Patent is hereby corrected as shown below:

On the title page, Item (75), the 3rd inventor's name is incorrect. Item (75) should read:

-- Inventors: Yoshio Wakazono, Nagoya (JP);
Toshihiko Shima, Okazaki (JP);
Eiji Kato, Nagoya (JP) --

Signed and Sealed this

Twenty-eighth Day of November, 2006

JON W. DUDAS
*Director of the United States Patent and Trademark Office*